US008858085B2

(12) United States Patent
Hiesener et al.

(10) Patent No.: US 8,858,085 B2
(45) Date of Patent: Oct. 14, 2014

(54) UPPER RUDDER CARRIER BEARING

(75) Inventors: Jorg Hiesener, Hamburg (DE); Manfred Nagel, Henstedt-Ulzburg (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 58 days.

(21) Appl. No.: 13/393,610

(22) PCT Filed: Sep. 2, 2010

(86) PCT No.: PCT/EP2010/062916

§ 371 (c)(1),
(2), (4) Date: Apr. 9, 2012

(87) PCT Pub. No.: WO2011/026922

PCT Pub. Date: Mar. 10, 2011

(65) Prior Publication Data

US 2012/0275734 A1 Nov. 1, 2012

(30) Foreign Application Priority Data

Sep. 2, 2009 (DE) ..... 20 2009 011 852 U
Oct. 1, 2009 (DE) ..... 20 2009 013 211 U

(51) Int. Cl.
*F16C 17/10* (2006.01)
*B63H 25/06* (2006.01)

(52) U.S. Cl.
USPC ..... 384/228; 114/169

(58) Field of Classification Search
CPC ..... F16C 17/10; F16C 17/14; F16C 17/26; F16C 33/10; B21D 53/10; B63H 25/52
USPC ..... 384/129, 169, 226, 228, 300, 397, 420; 114/169
See application file for complete search history.

(56) References Cited

U.S. PATENT DOCUMENTS

| | | | | |
|---|---|---|---|---|
| 2,318,114 | A | 5/1943 | Tichvinsky | |
| 3,110,530 | A * | 11/1963 | Herman | 384/298 |
| 3,467,045 | A | 9/1969 | Brohl | |
| 3,919,962 | A * | 11/1975 | Clay | 114/169 |
| 3,942,466 | A | 3/1976 | Bunyan | |
| 4,540,294 | A | 9/1985 | Lamperski et al. | |
| 4,802,430 | A | 2/1989 | Kramer | |
| 5,529,399 | A * | 6/1996 | Holze | 384/107 |
| 5,599,109 | A | 2/1997 | Negwer | |

(Continued)

FOREIGN PATENT DOCUMENTS

| | | | |
|---|---|---|---|
| CN | 101434294 | A | 5/2009 |
| DE | 700 528 | C | 12/1940 |

(Continued)

OTHER PUBLICATIONS

Translation of DE 4426953 obtained on Jul. 15, 2013.*

(Continued)

*Primary Examiner* — James Pilkington
(74) *Attorney, Agent, or Firm* — Kelly & Kelley, LLP

(57) ABSTRACT

An upper rudder carrier bearing for a ship which has a bearing housing formed of a housing base body and a housing cover. An axial and a radial bearing are disposed in the bearing housing, which are both configured as plain bearings. The axial and/or the radial bearing is configured as a self-lubricating bearing.

17 Claims, 4 Drawing Sheets

(56) References Cited

U.S. PATENT DOCUMENTS

| | | | | |
|---|---|---|---|---|
| 6,149,337 | A * | 11/2000 | Newton et al. | 403/122 |
| 6,464,396 | B1 * | 10/2002 | Schubert et al. | 384/273 |
| 6,929,402 | B1 * | 8/2005 | Titus | 384/107 |
| 6,945,186 | B2 | 9/2005 | Lehmann | |
| 2003/0161559 | A1 | 8/2003 | Kurobe et al. | |
| 2004/0028303 | A1 | 2/2004 | Ueno et al. | |
| 2004/0195275 | A1 | 10/2004 | Thomson et al. | |
| 2007/0094881 | A1 | 5/2007 | Kluge et al. | |
| 2008/0229993 | A1 | 9/2008 | Seo et al. | |

FOREIGN PATENT DOCUMENTS

| | | | |
|---|---|---|---|
| DE | 11 94 285 | B | 6/1965 |
| DE | 19 21 887 | U | 8/1965 |
| DE | 15 06 740 | B | 8/1971 |
| DE | 22 44 731 | A | 3/1973 |
| DE | 257 618 | A1 | 6/1988 |
| DE | 38 42 172 | A1 | 6/1990 |
| DE | 41 18 282 | C1 | 8/1992 |
| DE | 43 36 915 | A1 | 5/1995 |
| DE | 4426953 | A1 | 2/1996 |
| DE | 195 26 497 | A1 | 6/1996 |
| DE | 196 46 898 | A1 | 5/1998 |
| DE | 201 18 779 | U1 | 3/2002 |
| DE | 10335485 | A1 | 3/2005 |
| DE | 20 2005 019 626 | U1 | 3/2006 |
| FR | 2 235 616 | A5 | 1/1975 |
| GB | 2 206 324 | A | 1/1989 |
| JP | S62-6894 | A | 1/1987 |
| JP | S62-15199 | A | 1/1987 |
| JP | H8-230791 | A | 9/1996 |
| JP | 10-316094 | A | 12/1998 |
| JP | 2001-71996 | A | 3/2001 |
| JP | 2001-124070 | A | 5/2001 |
| JP | 2003-21144 | A | 1/2003 |
| JP | 2003-194046 | A | 7/2003 |
| WO | 2007073071 | A1 | 6/2007 |
| WO | 2009/012305 | A2 | 1/2009 |

OTHER PUBLICATIONS

Yuewen Bi: "Design and installation of 4000 DWT multi-purpose carrier flapped rudder", Ship Engineering, pp. 1-3, vol. 31, No. 3, 2009.

"Thordon bearings", World Fishing, Aug. 1992, (p. 31, picture and 2nd col., 3rd paragraph—3rd column, 1st paragraph).

* cited by examiner

Section B - B

UPPER RUDDER CARRIER BEARING

FIELD OF THE INVENTION

Background of the Invention

The invention relates to an upper rudder carrier bearing for mounting a rudder post of a watercraft, in particular a ship.

PRIOR ART

Known rudders comprise a rudder blade and a rudder post connected to the rudder blade, about which the rudder blade is rotatable. The rudder post is generally mounted by means of two bearings in the hull. An upper rudder carrier bearing is in this case disposed on the upper end of the rudder post facing the steering engine located in the interior of the ship. A lower rudder post bearing on the other hand is usually disposed further in the direction of the other end of the rudder post on the rudder blade side and in particular shortly before the emergence of the rudder post from the hull or the skeg. If only one bearing is to be provided in the hull or on the skeg for mounting the rudder post, the upper rudder carrier bearing according to the invention may be used as this one bearing.

The upper rudder carrier bearings known from the prior art are usually configured as radial bearing which become worn due to the frequent turning of the rudder post when setting the rudder in the course of operation and need to be renewed frequently. Considerable costs are incurred as result of the maintenance thus required and the ensuing lay times of the watercraft. Furthermore, a separate axial bearing is normally provided for mounting the rudder post in the axial direction, which is also subject to wear and must be maintained relatively frequently. As a result, the mounting or assembly of the bearings of the rudder post is relatively expensive, complex and cost-intensive.

SUMMARY OF THE INVENTION

It is therefore the object of the present invention to provide an upper rudder carrier bearing which overall simplifies the mounting structure of the rudder post and reduces the maintenance expenditure.

Accordingly, the rudder carrier bearing according to the invention has a bearing housing which is preferably formed in two parts and particularly preferably comprises a housing base body and a housing cover. Both an axial bearing and a radial bearing are disposed in the bearing housing. Since both axial and radial bearing are configured to be disposed in a single housing or are configured to be integrated in the housing, an extremely compact arrangement and easy installation and dismantling of the rudder carrier bearing is possible. Furthermore, both the axial and the radial bearing are configured as plain bearings, i.e. the elements to be mounted (bearing elements) move directly past one another or only separated by a lubricating film. By this means, the structure is further simplified since no additional rolling bodies or the like need to be provided.

Furthermore, the axial bearing and/or the radial bearing are configured as self-lubricating bearings. Self-lubricating bearings are also called "solid friction bearings" since friction between solids generally occurs in these bearings. This is due to a self-lubricating property of one of the partners or one of the bearing elements. These bearings do not need additional lubrication or lubricant since solid lubricants embedded in the material of which they are made are provided, which reach the surface during operation due to microwear and thereby lower friction and wear of the bearings. In particular plastics or plastic composites and/or ceramic structural materials are used to form such bearings or one of the normally two bearing elements which are movable relative to one another. Examples of such materials are PTFE (polytetrafluoroethylene) and ACM (acrylate rubber). Graphite-containing materials can also be used. In one embodiment, however, exclusively plastics and optionally additional metal materials and no ceramic materials can be used. In particular, composite materials can also be used to manufacture at least one of the bearing elements of the axial and/or radial bearing configured as a self-lubricating bearing, wherein at least one of the components of the composite material then has a solid lubricant. Advantageously no vulcanised rubber, "rubber" or similar elastic materials are used. By this means, the structure of the rudder carrier bearing according to the invention is further simplified since no additional means for providing a lubricating film or the like and no external lubricants need to be provided. From ecological aspects, the present invention is also advantageous since no lubricants, for example, grease can enter into the environment from the bearing. It is further advantageous that in contrast to conventional bearings frequently consisting of metal, in which for example one of the bearing elements is made of bronze, the risk of seizing in self-lubricating bearings is almost eliminated. Furthermore, such bearings are also extremely low-maintenance. It is advantageous that the upper rudder carrier bearing according to the invention does not require any oil/grease lubrication or other external lubrication. This is permanently the case, i.e. throughout the entire operating time and not merely during emergency operation or in the short term.

Furthermore, in a rudder carrier bearing comprising at least one self-lubricating bearing, the requirements for the seal of the rudder carrier bearing are not so high as in the bearings lubricated with external lubricants, known from the prior art since there is no risk of a lubricant escaping from the bearing into the environment. By this means the structure of the rudder carrier bearing is further simplified. It is particularly appropriate to configure both the axial and the radial bearing as self-lubricating bearings since the advantages according to the invention can be increased as a result.

The bearing housing can fundamentally be manufactured in any suitable form and in any suitable material, a metallic material, in particular steel, being preferably used. Moreover, the formulation that the axial and the radial bearing "are disposed in the bearing housing" should be understood in the present context in such a manner that the two bearings can each be disposed inside the bearing housing and also can be integrated therein, i.e., for example, in the case of a multi-part configuration of the bearing housing, parts of the axial and/or of the radial bearing can also be disposed between individual parts of the bearing housing or in edge zones of the housing or the housing parts. The crucial thing is that the bearing housing together with the axial and the radial bearing forms a unit and is therefore configured compactly. The bearing housing is advantageously configured to be closed and/or sealed towards the outside.

In principle, the upper rudder carrier bearing according to the invention can be provided in all known types of rudder, i.e. fully floating rudders, semi-spade type rudders or rudders mounted in the stern. The bearing could also be used in other control or manoeuvring systems of watercraft, for example, on rotary Kort nozzles or the like. Preferably the upper rudder carrier bearing is used for rudders, especially fin rudders for ships in the commercial or military field. These include both ocean-going ships and inland navigation vessels. The carrier bearing is not usually suitable for motor boat or the like.

In principle, the upper carrier bearing is designed in such a manner that it can withstand tilting movements or reciprocating rotary movements up to a maximum deflection of ±70°. No further swivelling usually takes place with rudders. Thus, the upper rudder carrier bearing according to the invention is not configured for revolving rotating shafts or similar, as is the case with other types of bearings. In this respect, the carrier bearing according to the invention is not a bearing for continuous rotational or rotary movements but for tilting movements up to a maximum of ±70°.

In the rudders for which the upper rudder carrier bearing according to the invention is particularly suited, that is for ships from the commercial or military field, the rudder posts frequently have long lengths so that the rudder carrier bearing only covers a fraction of the total length of the rudder post. In other words, the length of the rudder carrier bearing in the axial direction is only a fraction of the length of the rudder post. In particular, the length of the rudder carrier bearing can be less than 50%, preferably less than 30%, particularly preferably less than 20% of the length of the rudder post. Such a configuration contributes towards a compact design of the entire rudder arrangement.

In a preferred embodiment of the invention, the bearing housing consists of a housing base body and housing cover, i.e. is formed in two parts. The housing base body is advantageously configured in such a manner that it comprises the rudder post and the radial bearing. In particular, the housing base body can be configured to be cylindrical. The housing cover, on the other hand, is rather configured to be flat or disk- or plate shaped and has a passage for passage of the rudder post. in the mounted state, the housing cover is expediently disposed above the housing base body, i.e. facing the end of the rudder post on the steering engine side. The axial bearing can in particular be disposed between the housing base body and the housing cover.

Plain bearings generally comprise two bearing elements, i.e. two elements to be mounted which are directly movable with respect to one another. In a further preferred embodiment, the axial bearing has a first bearing element which comprises a non-metallic material, in particular plastic and preferably consists completely of this non-metallic material. In particular, this non-metallic material can be a plastic or a plastic composite. This plastic bearing element expediently has an embedded solid lubricant, with the result that the bearing element has self-lubricating properties and no additional lubrication by oil or grease need be provided. In particular, it is preferred that the first bearing element is configured as an annular disk, wherein the inner circular opening of the annular disk is dimensioned in such a manner that the rudder post can be passed therethrough and the radial bearing can optionally be disposed between outer ring of the annular disk and rudder post. Such a bearing element or such a plastic or "synthetic" annular disk can particularly preferably consist of a plastic composite made of base polymer, reinforcing materials (e.g. fibres) and from embedded solid lubricants. Examples of such composites are Thordon and Orkot®.

In particular, it is preferred that the first bearing element of the axial bearing having a solid lubricant is fastened to the bearing housing. The fastening can preferably be made by means of a screw connection or bolted connection. Other suitable connecting methods known from the prior art are also possible. If the bearing housing consists of a housing cover and a housing base body, the first bearing element is preferably fastened to the housing base body, particularly preferably to its upper front face.

Alternatively or additionally, the radial bearing also has a first bearing element which comprises a non-metallic material, in particular plastic and preferably consists completely of the non-metallic material. In the same way as in the axial bearing, the non-metallic material can be a plastic, wherein here the aforesaid examples for plastics can preferably also be used. In other words, the material of the material of the first bearing element of the radial bearing can be configured to be the same as the previously described material of the first bearing element of the axial bearing. By this means, the same advantages as for the radial bearing are achieved with the axial bearing, i.e. in particular a low maintenance requirement and a simplified structure of the bearing or the rudder carrier bearing.

The first bearing element of the radial bearing can particularly advantageously be configured as a bearing bush disposed around the rudder post. Furthermore, the bearing bush is expediently disposed within the bearing housing or the housing base body. In this arrangement, the bearing bush or the first bearing element is fastened with its outer jacket on the inner side or on the jacket of the bearing housing. The fastening can be carried out in particular by means of joining by thermal expansion or gluing, wherein in principle, other suitable joining methods known from the prior art can also be used. The first bearing element of the axial bearing and the first bearing element of the radial bearing are in principle two separate components. However, it is also possible to execute these as one component.

Expediently, both the axial and/or the radial bearing have a second bearing element, wherein the first and the second bearing element are movable with respect to one another and wherein preferably the second bearing element consists of a metallic material, in particular stainless steel. Due to the first bearing element having a solid lubricant in both bearings, a sufficient lubrication is ensured in each case between the two bearing elements, wherein a metallic material, in particular stainless steel, is particularly well suited as a bearing partner for the first bearing element. The second bearing element of the axial bearing can, for example, be configured as another annular disk, the two annular disks being twistable with respect to one another. The second bearing element of the radial bearing can, for example, be a sleeve applied directly to the post and surrounding said post or a post cover which moves with the post and with respect to the first bearing element attached firmly to the housing, in particular configured as a bearing bush. In principle, the first bearing element of the radial bearing can also move directly with respect to the rudder post, the rudder post itself then forming the second bearing element.

The individual bearing elements of the axial bearing and/or the radial bearing are preferably formed in one part or one piece. In other words, for example, the bearing rings of the axial bearing are formed in one piece, in the same way as possibly the bearing bushes or the sleeve of the radial bearing. This contributes towards a more stable bearing configuration. It is further preferred that the bearing faces, i.e. those faces of the bearing elements of the respective bearing which slide on one another, are aligned substantially parallel and/or orthogonal to the longitudinal axis of the rudder post. In particular, it is expedient that the bearing face of the radial bearing is disposed parallel to the rudder post axis and the bearing face of the axial bearing is disposed at right angles hereto. In particular, the bearing faces should not have any conical surfaces or surfaces running obliquely to the rudder post longitudinal axis. For such a preferred alignment of the bearing faces, maximum forces can be absorbed and an optimal ratio of dimensions to force absorbing capability of the upper rudder carrier bearing can be achieved.

It is further expedient to configure the rudder carrier bearing according to the invention in such a manner that the ratio of the width of the axial bearing or the width of the bearing face of the axial bearing to the diameter of the rudder post is 1:3, preferably 1:4.5, particularly preferably 1:5.5. In other words, the diameter of the rudder post in this embodiment is 3 times, preferably 4.5 times, particularly preferably 5.5 times larger than the width of the axial bearing. A particularly compact structure of the carrier bearing is thereby achieved. In another embodiment it is preferred that the ratio between the diameter of the post and the diameter of the housing of the rudder carrier bearing is 1:1.25 to 1:1.75, preferably 1:1.35 to 1:1.65. Any flanges or similar which project from the housing for fastening purposes are not included in the diameter of the housing. An optimal, compact rudder carrier bearing arrangement can also be achieved by this means.

If the bearing housing is formed in two parts, in particular comprising a housing base body and a housing cover, it is expedient if the first bearing element of the axial bearing is fastened to a housing part, in particular to the housing base body and that the second bearing element of the axial bearing is fastened to the other housing part, in particular to the housing cover. In this case, not only the two bearing elements but with them also the two housing parts are movable with respect to one another. In particular, one housing part, for example, the housing cover can be fastened on the rudder post so that the housing cover and the second bearing element fastened thereon turn together with this. Accordingly, the other housing part, in particular the housing base body must be fixed or fastened to the hull. In this embodiment, it is particularly expedient that the axial bearing disposed in the housing is disposed between the two housing parts. Particularly preferably in this embodiment the bearing elements of the axial bearing are configured as annular disks and those of the radial bearing are configured as bushes or sleeves. This further simplifies the structure since these are commonly used components in terms of the geometrical dimensions, which can frequently be purchased directly already in the form or dimension required and need not be manufactured specially. Also no loss of material ensues as the case, for example, when a special bearing element shape must be milled or turned from a blank.

Expediently, the bearing housing has a fastening section, in particular an outwardly projecting flange, by which means the bearing housing or the rudder carrier bearing can be fastened on the watercraft body. By this means a stable connection can be achieved between bearing housing and watercraft body. In particular, the fastening section can be connected to the watercraft body by means of welding. On the other hand, the bearing housing is not normally directed to the rudder trunk.

If the bearing housing is formed in two parts, the fastening section is expediently provided on that housing part to which the radial bearing is fastened.

It is furthermore expedient if the upper rudder carrier bearing comprises sealing means for sealing the carrier bearing, in particular in the region of the radial bearing. In particular, the sealing means can be disposed in the lower region, i.e. the region of the bearing housing facing the rudder blade or underneath the bearing housing. This avoids particles or the like, which interfere with the plain bearing, from being able to penetrate from outside into the rudder carrier bearing.

The object forming the basis of the invention is further achieved by a rudder arrangement for watercraft, in particular ships, which has an upper rudder carrier according to the invention. Such a rudder arrangement generally further comprises a rudder blade and a rudder trunk for receiving a rudder post. Preferably in such a rudder arrangement the upper rudder carrier bearing is configured to be integrated in the rudder trunk and/or is placed on the upper end of the rudder trunk facing away from the rudder blade. In other words, upper rudder carrier bearing and rudder trunk can be formed as a unit, wherein the rudder carrier bearing can be formed in the rudder trunk or integrated therein or it can be disposed adjacent to or contiguous to said trunk, wherein in particular in the latter case, rudder carrier bearing and rudder trunk are connected positively and/or non-positively to one another. The formulation "placed on the rudder trunk" should be understood in the present context in such a manner that the rudder carrier bearing adjoins the end of the rudder trunk facing the steering engine or facing away from the rudder blade. As a result of such an integrated design of rudder carrier bearing and rudder trunk, the structure of the rudder arrangement is overall more compact and manufacture is simplified insofar as complete units of rudder carrier bearing and rudder trunk can be installed together or dismantled in the case of maintenance.

It is particularly preferred if the upper end of the rudder trunk facing away from the rudder blade, in particular on its inner side, has a recess which is configured to receive a sealing means and/or a complementary counterpart of the rudder carrier bearing, which is provided in particular on the bearing housing and is preferably configured as a flange projecting from the front face of the bearing housing facing the rudder trunk. The counterpart of the rudder carrier bearing is formed in such a manner that it fits positively into the recess so that a bond is made and rudder carrier bearing and trunk appear as a unit. Alternatively or additionally, a sealing means can be provided in the recess. By this means a stable integral design of rudder trunk and rudder carrier bearing with appurtenant sealing means can be provided. In the present context, sealing means can be all suitable sealing means known from the prior art, for example, elastic rubber seals or the like. The sealing means can in particular comprise seawater seals whose functionality consists in sealing the interior of the rudder carrier bearing with respect to the external lake water or sea water. Such seals are frequently located in the lower area of the rudder blade carrier bearing facing the rudder blade. Preferably no sealing means are disposed between housing base body and housing cover of the rudder carrier bearing. A seal is achieved by the contact points between housing base body and housing cover each having a bearing ring of the axial bearing, which form the contact points between housing base body and housing cover and which rest firmly on one another. Since the axial bearing is configured to be self-lubricating and therefore requires no extra oil lubrication or similar, additional sealing means can advantageously also be dispensed with. Additional oil or lubricant seals are also fundamentally not required.

For an optimal integral configuration, it is further advantageous that the outer side surfaces of the rudder trunk and the bearing housing of the upper rudder carrier bearing are disposed flush with respect to one another and the rudder trunk and bearing housing abut directly against one another. As a result of the flush manner of formation with respect to one another, the outer surfaces of trunk and rudder carrier bearing go over into one another.

It is furthermore preferred that the radial and/or axial bearing each abut directly against the rudder post. Particularly preferably in one embodiment only the radial bearing abuts directly against the rudder post. The term "direct abutment" is to be understood such that at least one component of the particular bearing rests against the rudder post or touches this. In the case of the radial bearing, this can advantageously, for example, be the rudder post sleeve (so-called "liner") which rests firmly on the rudder post. In other words, the radial and/or the axial bearing is not located at a distance from the rudder post. By this means, a particularly compact configuration of the rudder carrier bearing can be achieved. In the carrier bearings known from the prior art, on the other hand, additional bearing or carrier bodies are frequently provided, which have the function of functionally connecting the radial and/or the axial bearing to the rudder post. These bearing or carrier bodies thereby frequently lie on the rudder post and are firmly connected to this. In turn, the radial and/or axial bearing rests on another, frequently opposite, side of the bearing or carrier body. This frequently results in relatively large carrier bearing assemblies which are complex to manufacture. Furthermore, specific connection means such as a tongue-groove connection or similar must frequently be provided for such bearing or carrier bodies. In particular, a groove or a notch will frequently need to be provided in the bearing shaft. In the configuration according to the carrier bearing according to the invention in which the radial bearing rests directly on the rudder post, this is not necessary, at least not for both bearings (axial and radial bearing) since a rudder sleeve can simply be firmly attached on the rudder post.

In a further preferred embodiment, when viewed in the radial direction from the rudder post or from the carrier bearing, the axial bearing is located further outwards than the radial bearing. In other words, the distance between rudder post longitudinal axis and radial bearing in the radial direction is shorter than the distance between rudder post longitudinal axial and axial bearing. Accordingly a particularly compact and technically favourable configuration or arrangement of the carrier bearing according to the invention can be achieved.

In addition, the object forming the basis of the invention is achieved by a rudder carrier bearing kit for manufacturing an upper rudder carrier bearing for mounting a rudder post of a rudder of a watercraft, in particular a ship, which comprises a bearing housing, comprising a housing base body and a housing cover, an axial bearing comprising a first annular disk made of a metallic material, in particular stainless steel and a second annular disk made of a material comprising a solid lubricant, in particular non-metallic, a radial bearing made of a material comprising a solid lubricant, in particular non-metallic, and optionally a rudder post sleeve made of a metallic material, in particular stainless steel, and optionally a sealing means. This kit can in particular be configured to manufacture a rudder carrier bearing according to the invention. In particular, ACM, PTFE, Thordon or Orkot® can be considered for the material of the annular disk or the bearing bush comprising a solid lubricant. In principle, the kit can be of a complete nature so that no further additional materials or components need be added for the manufacture of the rudder carrier bearing. However, the provision of further additional components is readily possible.

Furthermore, the object forming the basis of the invention is achieved by a method for manufacturing an upper rudder carrier bearing, in which a bearing housing that comprises a first sleeve-like housing part, in particular a housing base body, and a second housing part, in particular a housing cover, is provided. In addition, a bearing bush comprising a material having a solid lubricant, is inserted and fastened into the first housing part, in particular by joining by means of thermal expansion and/or gluing. Furthermore, a first bearing annular disk is fastened on the first housing part, in particular by means of screwing, and a second bearing annular disk associated with the first bearing annular disk is fastened on the second housing part, wherein the first and/or the second bearing annular disk comprises a material having a solid lubricant. The first and the second bearing annular disk are associated with one another in such a manner that they each form a bearing element of a plain bearing and are thus movable with respect to one another. Since at least one of the two bearing annular disks has a solid lubricant, the bearing formed from the two bearing annular disks is configured to be self-lubricating. Preferably the bearing bush can also have a solid lubricant.

BRIEF DESCRIPTION OF THE DRAWINGS

The invention is explained further with reference to an exemplary embodiment shown in the drawings. Schematically in the figures.

DETAILED DESCRIPTION OF THE INVENTION

Figure 1:
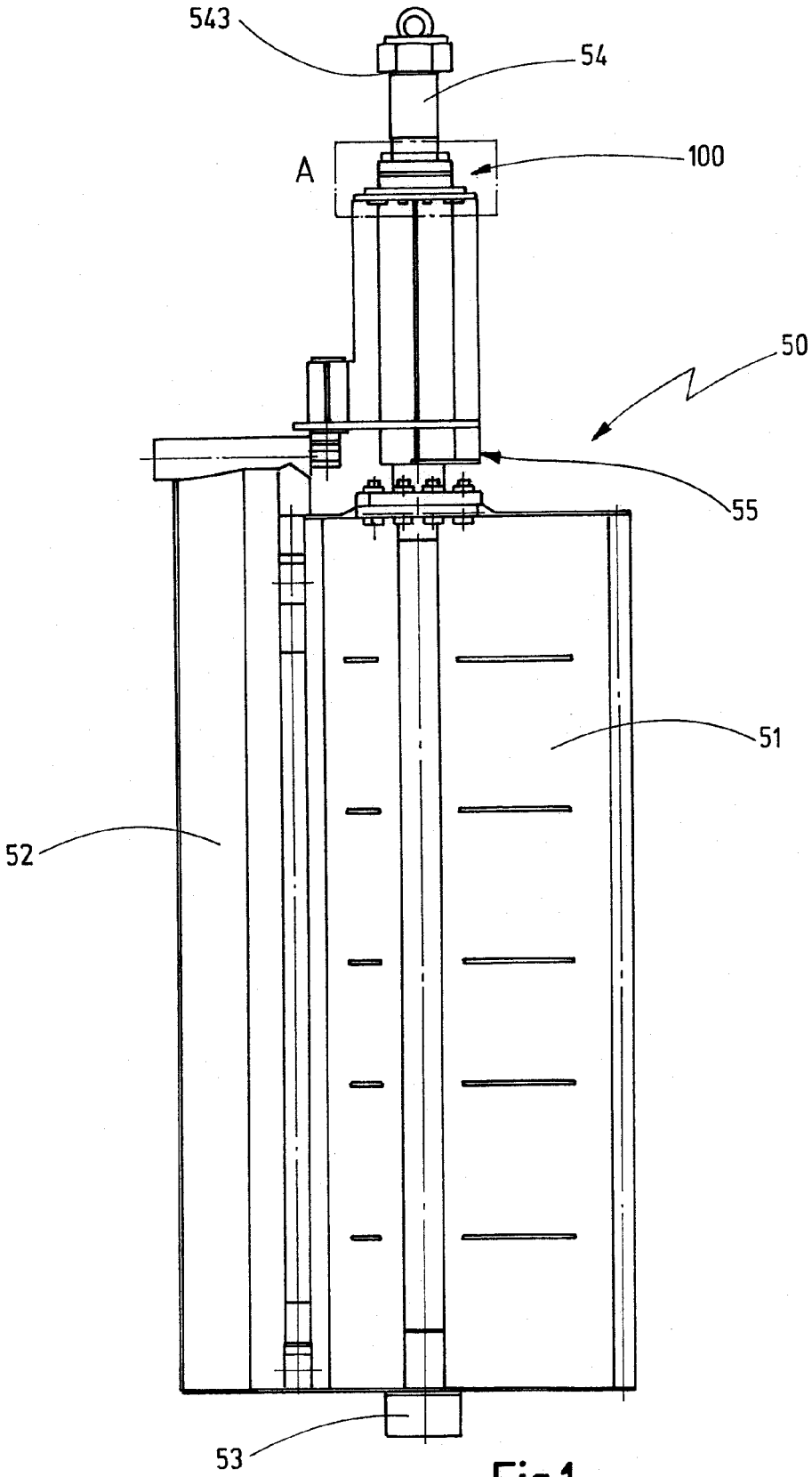
FIG. 1 shows a side view of a fin rudder with upper rudder carrier bearing.

FIG. 1 shows a side view of a fin rudder 50 which has a rudder blade 51 and a force-controlled fin 52 mounted in an articulated manner on the rudder blade 51. The rudder type shown in FIG. 1 is a so-called "rudder mounted in the stern" which is mounted in the upper and in the lower rudder region. On the lower side the rudder 50 has a pivot journal 53 for mounting in the stern of a ship (not shown here). In the upper region, on the other hand, there is provided a rudder post 54 about which the rudder blade 51 is rotatable. To this end the rudder post 54 is firmly connected to the rudder blade 51. The rudder post 54 is mounted by means of a lower bearing 55 located just above the rudder blade 51 and by an upper rudder carrier bearing 100. The upper rudder carrier bearing 100 is located in the vicinity of the upper end 543 of the rudder post 54 facing a steering engine of a ship (not shown here).

Figure 2:
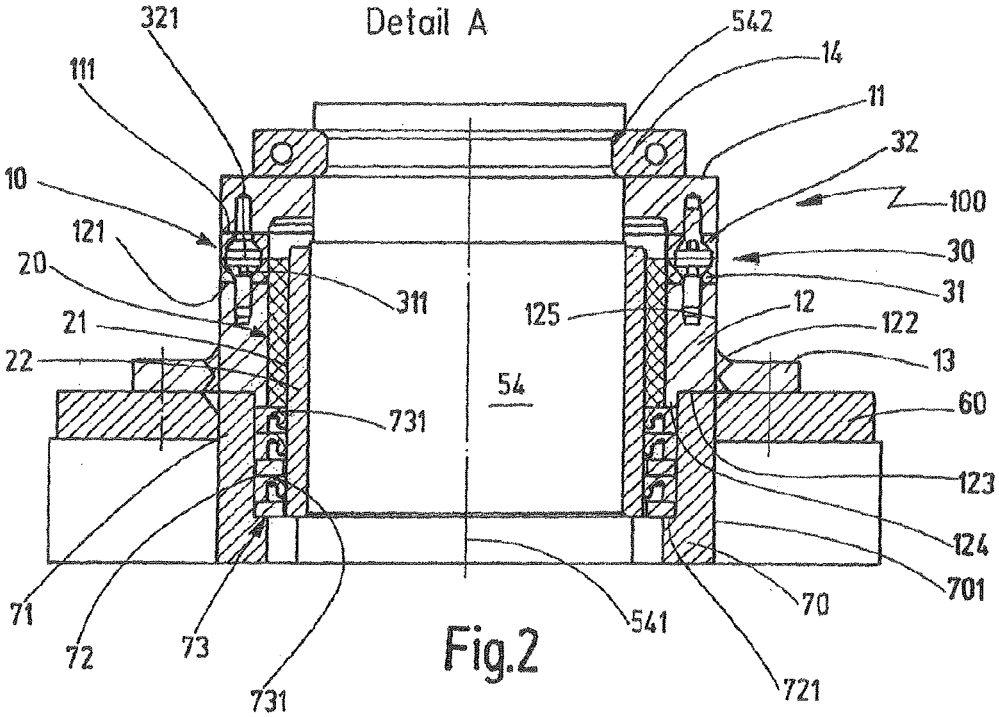
FIG. 2 shows a sectional view of the upper rudder carrier bearing.

FIG. 2 shows a sectional view of the detail A from FIG. 1. The upper carrier bearing 100 shown in FIG. 2 comprises a bearing housing 10 which comprises an upper housing cover 11 and a lower housing base body 12. The housing cover 11 and the housing base body 12 are made of stainless steel. The housing base body 12 is configured in the form of a cylindrical sleeve having a fastening section 13 configured as a flange, projecting outwardly by about 90°, provided on its lower, outer edge region. The fastening section 13 is connected to the housing base body 12 by means of a weld 122. The fastening section 13 is in turn firmly connected to a strutting 60 of the hull, for example, by means of a screw connection. Provided in the interior of the housing base body 12 is a radial bearing 20 comprising a bearing bush 21 which forms a first bearing element and a rudder post sleeve or a rudder post cover 22 which forms a second bearing element. The cylindrical bearing bush 21 abuts with its outer jacket against the inner jacket of the housing base body 12 and is connected to the housing base body 12 by joining by means of thermal expansion, i.e. it is "iced" into the housing base body 12. The bearing bush 21 is made of a plastic or synthetic material and has self-lubricating properties. That is, the bearing bush 21 consists of a material which has a solid lubricant which is released during operation and lubricates the two bearing partners 21, 22 so that these can move approximately free from friction with respect to one another. The rudder post sleeve 22 is a cylindrical hollow body disposed around a rudder post 54, which is firmly connected to the rudder post 54 and co-rotates with this with respect to the fixed bearing bush 21 connected to the hull. The rudder post 54 is guided through the upper rudder carrier bearing 100. In the present example, the rudder post sleeve 22 is made of stainless steel.

Furthermore, the upper rudder carrier bearing 100 comprises an axial bearing 30 which comprises a first bearing element 31 configured as an annular disk and a second bearing element 32 also configured as an annular disk. The annular disk 31 is firmly connected to the housing base body 12 by means of a plurality of screws 311, wherein the annular disk 31 rests on the upper front face 121 of the housing base body 12 and is screwed there to this. The annular disk 31, like the bearing bush 21, is made of a synthetic or plastic material and has self-lubricating properties or a solid lubricant. Consequently, both the axial bearing 30 and the radial bearing 20 are configured as self-lubricating bearings. The second bearing partner 32 of the axial bearing 30 is configured as a stainless steel annular disk and screwed to the lower outer front face 111 of the housing cover 11 by means of a plurality of screws 321. The two annular disks 31, 32 are rotatable with respect to one another about the rudder post axis 541. As a result, the housing cover 11 can be twisted with respect to the housing base body 12 which is firmly connected to the hull 60. The housing cover 11, the housing base body 12, the two annular disks 31, 32, the bearing bush 21 and the rudder post sleeve 22 are all disposed coaxially to the rudder post 54.

Abutting against the upper side of the housing cover 11 is a metal clamping ring 14 which is not connected to the housing cover 11. In the region of the clamping ring 14 the rudder post 54 has a peripheral indentation 542 in which the clamping ring 14 engages. The clamping ring 14 is firmly connected to the rudder post 54 in the region of the indentation 542. The clamping ring 14 secures the rudder post 54 against displacement in the axial direction. The clamping ring 14 must first be removed to remove the rudder post 54 from the hull, e.g. for maintenance purposes.

The cylindrical housing base body 12 has an approximately 90° downwardly projecting flange 124 on its lower front face 123 in the region facing its inner side 126. A cylindrical rudder trunk 70 which is firmly connected to the hull and coaxially surrounds the rudder post 54, has a peripheral recess or indentation 72 in its upper end region 71 in the area of its inner side. The depth of the recess 72 is about a quarter to one fifth of the total thickness of the rudder trunk 70. The flange 124 engages positively in the recess 72 and corresponds in terms of its dimensions approximately to the depth or width of the recess 72. Disposed between the lower end region 721 of the recess 72 and the flange 124 engaging in the recess 72 are sealing means 73 which are configured in the form of five superposed sealing rings 731. The sealing means 73 are further disposed between the inner side of the recess 72 and the outer side of the rudder post sleeve 22. The outer sides or outer jackets 125, 701 of the housing base body 12 or the rudder trunk 70 are aligned flush with one another and give a flat surface when taken together. The housing base body 12 thus sits on the rudder trunk 70 so that overall an integrated configuration or arrangement of the upper rudder carrier bearing 100 with the rudder trunk 70 is obtained. It can further be identified in FIG. 2 that both axial bearing 30 and radial bearing 20 are disposed in or inside the housing 10. The two bearing elements 31, 32 of the axial bearing 30 are in this case located between the housing cover 11 and the housing base body 12 of the housing 10 formed in two parts.

Figure 3:
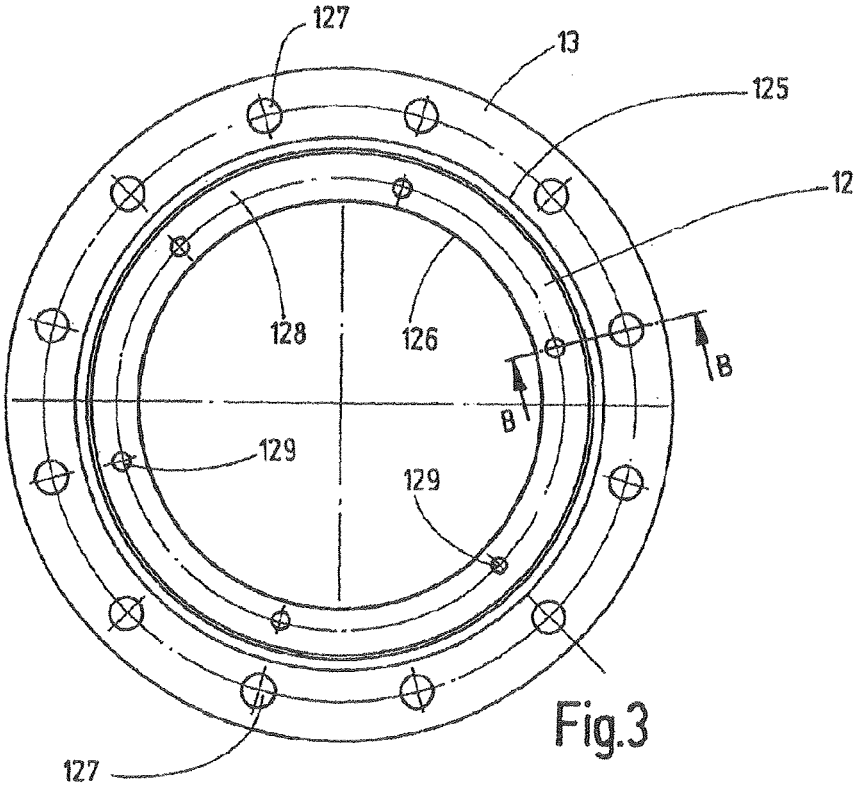
FIG. 3 shows a plan view of the housing base body of the upper rudder carrier bearing.

FIG. 3 shows a plan view of the housing base body 12. The cylindrical main part of the housing base body 12 in the plan view has a circular external circumference 125 and a circular internal circumference or a circular inner side 126. In the outside annular fastening section 13 of the housing base body 12 in the plan view, a plurality of circular openings 127 are provided, distributed over the circumference at equal intervals, through which screws can be passed for screwing to the hull 60. The inside, cylindrical main part 128 of the housing base body 12 also has a plurality of screw holes 129 which are distributed over its circumference at regular intervals.

Figure 5:
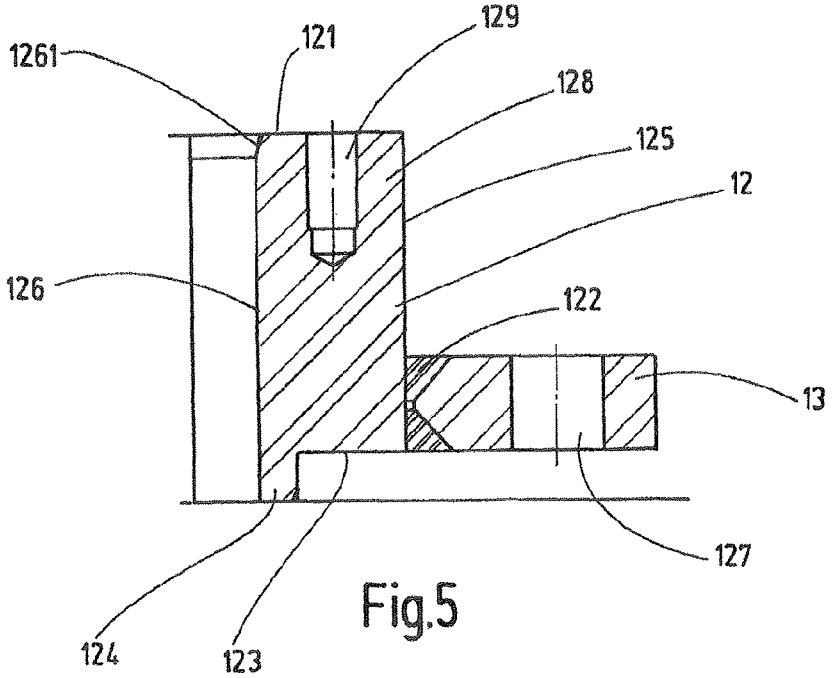
FIG. 5 shows a sectional view along the section B-B from FIG. 3.

FIG. 5 shows a section along the line of intersection B-B from FIG. 3. The screw hole or blind hole 129 is a recess in the upper front face 121 of the cylindrical main part 128 of the housing base body 12. The opening 127 on the other hand is configured to go through the fastening section 13. It can be seen that the width of the downward-projecting flange 124 corresponds to approximately a quarter of the total width of the main part 128 of the housing base body 12. The height of the flange 124 approximately corresponds to a seventh of the height of the main part 128. An inwardly running slope 1261, when viewed from bottom to top, is provided in the upper end region of the inner side or inner surface 126 of the main part 128. In other words, the surface of the inner side or the inner jacket 126 is configured to run peripherally sloping in its upper end region 1261.

Figure 4:
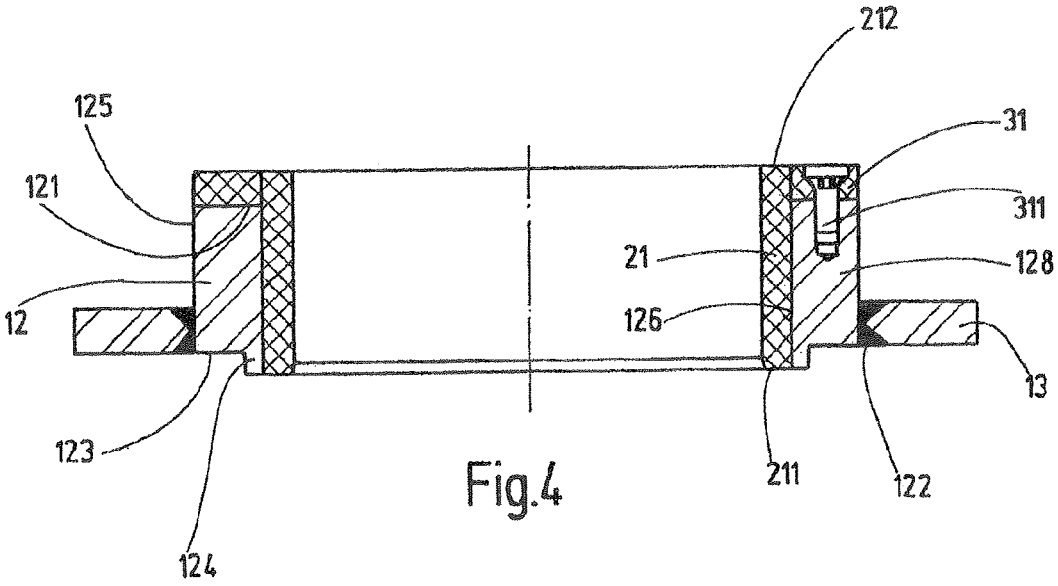
FIG. 4 shows a sectional view of the housing base body of the upper rudder carrier bearing with bearing bush and annular disk.

FIG. 4 shows a sectional view through the housing base body 12, wherein an interior bearing bush 21 and an annular disk 31 fastened on the upper front face 121 are provided thereon. The bearing bush 21 ends with its lower end 211 flush with the flange 124. At its upper end 212, on the other hand it ends flush with the upper side of the annular disk 31. In other words, the height of the bearing bush 21 corresponds to the overall height of the annular disk 31 and the main part 128 including flange 124. The width of the ring of the annular disk 31 corresponds to the width of the main part 128 so that these two components also end flush with one another, both on the inner side 126 and on the outer side 125. Since both bearing bush 21 and annular disk 31 are firmly connected to the housing base body 12, they form a unit which can be twisted towards the housing cover 11 with the annular disk 32.

Figure 6:
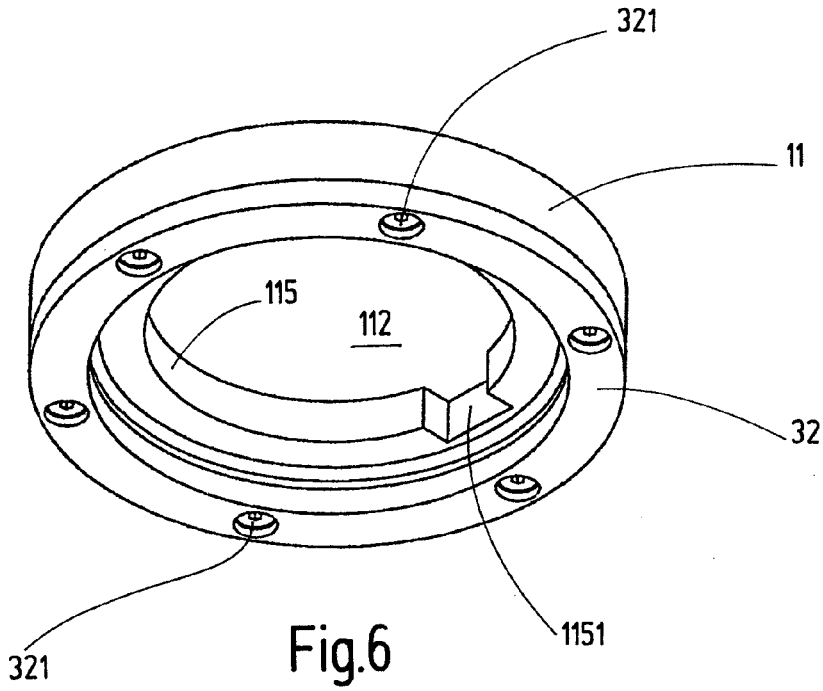
FIG. 6 shows a perspective view of the housing cover of the upper rudder carrier bearing with annular disk and FIG. 7 shows a sectional view of the housing cover of the upper rudder carrier bearing.
Figure 7:
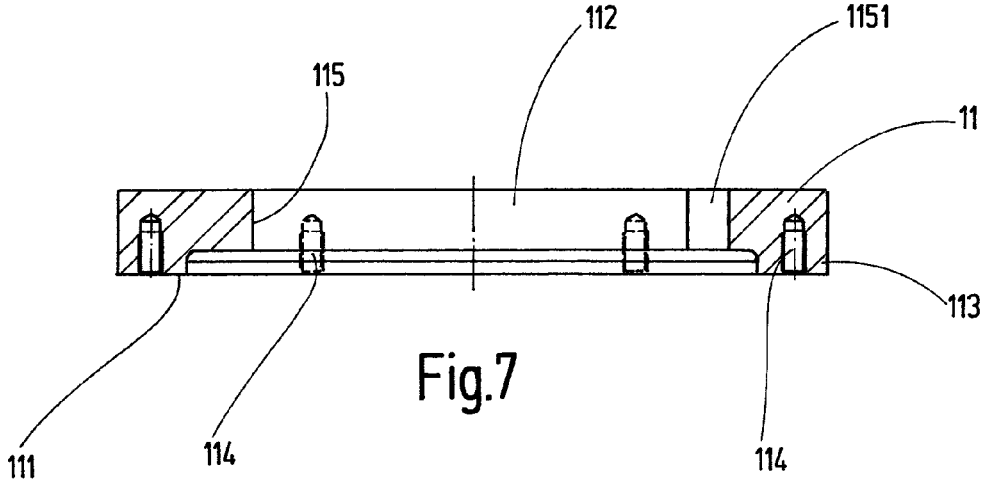

FIG. 6 shows a perspective view of the housing cover 11 with an annular disk 32 fastened thereon whilst FIG. 7 shows a section through the housing cover 11. The housing cover 11 has an inner aperture 112 which is configured to be circular and for passage of the rudder post 54. The housing cover 11 is formed in the manner of an annular perforated disk, having a peripherally disposed, downwardly projecting overhang region 113 in its outer lower edge zone. Peripherally distributed screw holes or blind holes 114 for making screw connections with screws 321 are provided in the overhang region 113. The annular disk 32 abuts flush against the lower front face 111 of the overhang region 113 and is fastened by means of screws 321 on the housing cover 11. Provided on the inner side 115 of the housing cover 11 in the region of the aperture 112 is a recess 1151 which has a U-shaped outline in cross-section. A (feather) key (not shown here) is provided on the rudder post 54, this being configured to engage in the recess 1151 in the sense of an entrainer. In this respect the housing cover 11 co-rotates with the rudder post 54 by this means.

The invention claimed is:

1. An upper rudder carrier bearing for the mounting of a rudder post of a rudder of a watercraft, characterized in that the rudder carrier bearing comprises:

a bearing housing; and an axial bearing and a radial bearing disposed in the bearing housing, which are both configured as plain bearings;

wherein the axial bearing and/or the radial bearing is configured as a self-lubricating bearing;

wherein the bearing housing comprises:

a housing base body with an upper front face and a housing cover with a lower front face;

wherein the housing cover is disposed above the housing base body;

wherein the axial bearing is disposed between the upper front face of the housing base body and the lower front face of the housing cover; and wherein the axial bearing comprises a first bearing element and a second bearing element, which are movable with respect to one another, wherein the first bearing element is fastened to the upper front face of the housing base body and wherein the second bearing element is fastened to the lower front face of the housing cover.

2. The upper rudder carrier bearing according to claim 1, characterized in that the first bearing element is configured as an annular disk which comprises a non-metallic material.

3. The upper rudder carrier bearing according to claim 2, characterized in that the first bearing element of the axial bearing is fastened to the bearing housing by means of a screw connection.

4. The upper rudder carrier bearing according to any one of the preceding claims, characterised in that the radial bearing has a first bearing element configured as a bearing bush which comprises a non-metallic material.

5. The upper rudder carrier bearing according to claim 4, characterized in that the first bearing element of the radial bearing is fastened to the bearing housing by means of joining by thermal expansion or gluing.

6. The upper rudder carrier bearing according to claim 4, characterized in that the radial bearing comprises a second bearing element, wherein the first bearing element and the second bearing element are movable with respect to one another and wherein the second bearing element comprises a metallic material.

7. The upper rudder carrier bearing according to claim 1, characterized in that an outwardly projecting flange is provided on the bearing housing, for fastening the rudder carrier bearing on the watercraft.

8. The upper rudder carrier bearing according to claim 1, characterized in that a seal is provided for sealing the rudder carrier bearing.

9. The upper rudder carrier bearing according to claim 1, characterized in that the radial bearing abuts against the rudder post.

10. The upper rudder carrier bearing according to claim 1, characterized in that the axial bearing is located further outwards in a radial direction of a rudder post than the radial bearing.

11. A rudder arrangement for watercraft, comprising an upper rudder carrier bearing according to claim 1.

12. The rudder arrangement according to claim 11, which has a rudder blade and a rudder trunk for receiving a rudder post, characterized in that the upper rudder carrier bearing is configured to be integrated in the rudder trunk and/or is placed on the upper end of the rudder trunk facing away from the rudder blade.

13. The rudder arrangement according to claim 11, which has a rudder blade and a rudder trunk for receiving a rudder post, characterized in that the upper end of the rudder trunk facing away from the rudder blade has a recess which is configured to receive a sealing means and/or a complementary counterpart of the rudder carrier bearing, which is provided on the bearing housing and is configured as a flange projecting from a lower front face of the bearing housing facing the rudder trunk.

14. The rudder arrangement according to claim 11, which has a rudder trunk for receiving a rudder post, characterized in that outer side surfaces of the rudder trunk and the bearing housing of the upper rudder carrier bearing are disposed flush with respect to one another and the rudder trunk and bearing housing abut directly against one another.

15. A watercraft having an upper rudder carrier bearing according to any one of claims 1-3.

16. A rudder carrier bearing kit for manufacturing an upper rudder carrier bearing for mounting a rudder post of a rudder of a watercraft, the kit comprising:

a bearing housing, including a housing base body and a housing cover;

an axial bearing comprising a first annular disk made of a material comprising a solid lubricant, and a second annular disk made of a metallic material;

a radial bearing comprising a bearing bush made of a material comprising a solid lubricant;

a rudder post sleeve made of a metallic material; and a sealing means, wherein the kit is configured to manufacture a rudder carrier bearing according to any one of claims 1 to 3.

17. A method for manufacturing an upper rudder carrier bearing, characterized by the steps:

providing a bearing housing that comprises a housing base body with an upper front face, and a housing cover with a lower front face;

inserting and fastening a bearing bush comprising a material having a solid lubricant, into the housing base body, by joining by means of thermal expansion and/or gluing;

fastening a first bearing annular disk on the housing base body upper front face, and fastening a second bearing annular disk associated with the first bearing annular disk on the housing cover lower front face, wherein the first and/or the second bearing annular disk comprises a material having a solid lubricant; and positioning the housing cover above the housing base body so that the first bearing annular disk and the second bearing annular disk are movable with respect to one another and disposed between the upper front face of the housing base body and the lower front face of the housing cover.

* * * * *